United States Patent [19]

Lewen

[11] Patent Number: 4,987,751

[45] Date of Patent: Jan. 29, 1991

[54] PROCESS TO EXPAND THE TEMPERATURE GLIDE OF A NON-AZEOTROPIC WORKING FLUID MIXTURE IN A VAPOR COMPRESSION CYCLE

[76] Inventor: Joseph M. Lewen, 4204 Grove Ave., Brookfield, Ill. 60513

[21] Appl. No.: 506,297

[22] Filed: Apr. 9, 1990

[51] Int. Cl.[5] ..... F25B 1/00

[52] U.S. Cl. ..... 62/502; 62/117; 62/498

[58] Field of Search ..... 62/114, 115, 117, 502, 62/503, 504, 476

[56] References Cited

U.S. PATENT DOCUMENTS

| | | | |
|---|---|---|---|
| 2,492,725 | 12/1949 | Ashley | 62/115 |
| 4,179,898 | 12/1979 | Vakil | 62/126 |
| 4,217,760 | 8/1980 | Vakil | 62/126 |
| 4,218,890 | 8/1980 | Vakil | 62/114 |
| 4,283,919 | 8/1981 | Vakil | 62/114 |
| 4,290,272 | 9/1981 | Vakil | 62/114 |
| 4,769,999 | 9/1988 | Fujiwara et al. | 62/114 |
| 4,781,738 | 11/1988 | Fujiwara et al. | 62/18 |

*Primary Examiner*—Albert J. Makay
*Assistant Examiner*—John Sollecito
*Attorney, Agent, or Firm*—Philip H. Kier

[57] ABSTRACT

Vapor compression refrigeration device using a non-azeotropic working fluid mixture with separation of liquid mixture and vapor mixture. The separation can occur at high pressure during condensation to expand the temperature glide, at low pressure during condensation, or both during evaporation and condensation. When there is separation during condensation the number of stages in the evaporator and in the condenser must be equal.

4 Claims, 3 Drawing Sheets

PROCESS TO EXPAND THE TEMPERATURE GLIDE OF A NON-AZEOTROPIC WORKING FLUID MIXTURE IN A VAPOR COMPRESSION CYCLE

BACKGROUND

1. Field of the Invention

This invention relates to vapor compression refrigeration cycles, and more specifically to such cycles that use non-azeotropic working fluid mixtures with means to expand the temperature glide.

2. Description of the Related Art

A basis vapor compression refrigeration cycle is described in U.S. Pat. No. 2,492,725 issued Dec. 27, 1949 under the title "Mixed Refrigerant System". The subject system describes a refrigeration cycle that uses non-azeotropic working fluid mixtures. All of the following related art also use non-azeotropic working fluid mixtures.

A vapor compression heat pump system is described in U.S. Pat. No. 4,179,898 issued Dec. 25, 1979 under the title "Vapor Compression Cycle Device With Multi-Component Working Fluid Mixture and Method for Modulating Its Capacity." It describes a method to modulate the mass flow rate in a heat pump system to improve its efficiency that involves the use of high-pressure and low-pressure liquid accumulators and a high-pressure vapor separator.

Vapor compression heat pump systems are described in U.S. Pat. No. 4,217,760 issued Aug. 19, 1980 under the title "Vapor Compression Cycle Device With Multi-Component Working Fluid Mixture and Method for Modulating Its Capacity" and U.S. Pat. No. 4,218,890 issued Aug. 26, 1980 under the title "Vapor Compression Cycle Device With Multi-Component Working Fluid Mixture And Improved Condensing Heat Exchanger." They describe methods to modulate the mass flow rate in a heat pump system to improve its efficiency. Both describe the use of high-pressure and low-pressure liquid accumulators to achieve this modulation.

A vapor compression cycle is described in U.S. Pat. No. 4,218,919 issued Aug. 18, 1981 under the title "Vapor Compression Cycle Device With Multi-Component Working Fluid Mixture and Methods of Modulating the Thermal Transfer Capacity Thereof." It describes a system with two stages of evaporation and with separation at an intermediate pressure.

Still-like devices for separation of vapor and liquid in vapor compression refrigeration cycles are described in U.S. Pat. No. 4,769,999 issued Sept. 13, 1988 under the title "Liquid-Gas Contractor for Non-Azeotropic Mixture Refrigerant" and in "U.S. Pat. No. 4,781,738 issued Nov. 1, 1988 under the title "Liquid-Gas Contractor for Non-Azeotropic Mixture Refrigerant."

SUMMARY OF THE INVENTION

The instant invention is a vapor compression refrigeration device using a non-azeotropic working fluid mixture. It has multicomponent separations at constant pressure during condensation and/or multiple separations during evaporation at constant pressure in a counterflow heat exchanger.

The temperature glide is the temperature difference between the vapor phase and the liquid phase of a non-azeotropic working fluid mixture during evaporation at constant temperature. Increasing the temperature glide increases the efficiency of a refrigeration device by reducing the work done by a compressor. One of the objectives of the instant invention, through separation during condensation, is to increase the temperature glide. Two additional objectives are associated with separation during evaporation. One of these objectives is to increase the temperature range at which the evaporator can operate without staging a compressor, or having two compressors in a parallel circuit. This results from increasing the temperature glide. The other additional objective is to make possible the use of hermetic compressors, rather than open compressors. Hermetic compressors are less expensive than open compressors and permit a simpler refrigeration cycle with fewer components.

DESCRIPTION OF THE PREFERRED EMBODIMENTS

Figure 1:
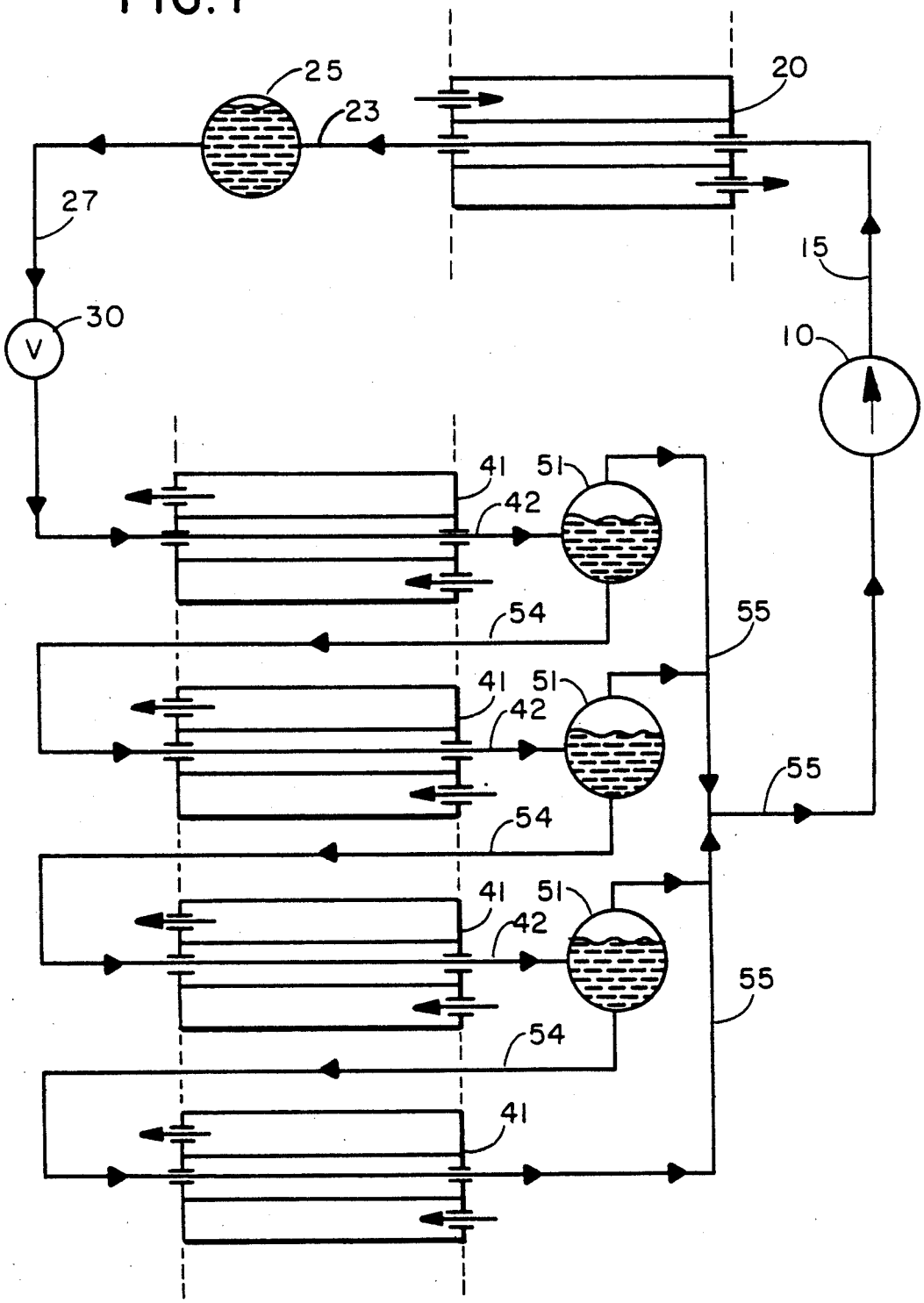
FIG. 1 of the drawings is a schematic graph of an embodiment of the vapor compression device in which there is separation during evaporation.

One preferred embodiment of the instant invention in which there is separation of liquid and vapor at low pressure during evaporation is illustrated in FIG. 1. A pipe 15, carrying a high pressure non-azeotropic vapor mixture, connects a compressor 10 and a conventional condenser 20. Pipe 23 carries the condensed mixture to a high pressure receiver 25 which is connected by pipe 27 to an expansion device 30 where it is expanded to a low pressure liquid mixture. The evaporator of this vapor compression refrigeration cycle contains a plurality of evaporator sections in series. FIG. 1 shows four evaporator sections 41. Each evaporator section has an associated low pressure separator 51 except the last section. Low pressure fluid mixture enters an evaporator section 41. The fluid mixture leaving each evaporator section, except the last, through pipe 42 is partly evaporated and enters a low pressure separator 51. Liquid mixture leaving a separator is transported in pipe 54 to the inlet of the next evaporator section. Vapor mixture leaving a separator, or the last section of the evaporator, is transported in pipe 55 to the compressor 10.

Figure 2:
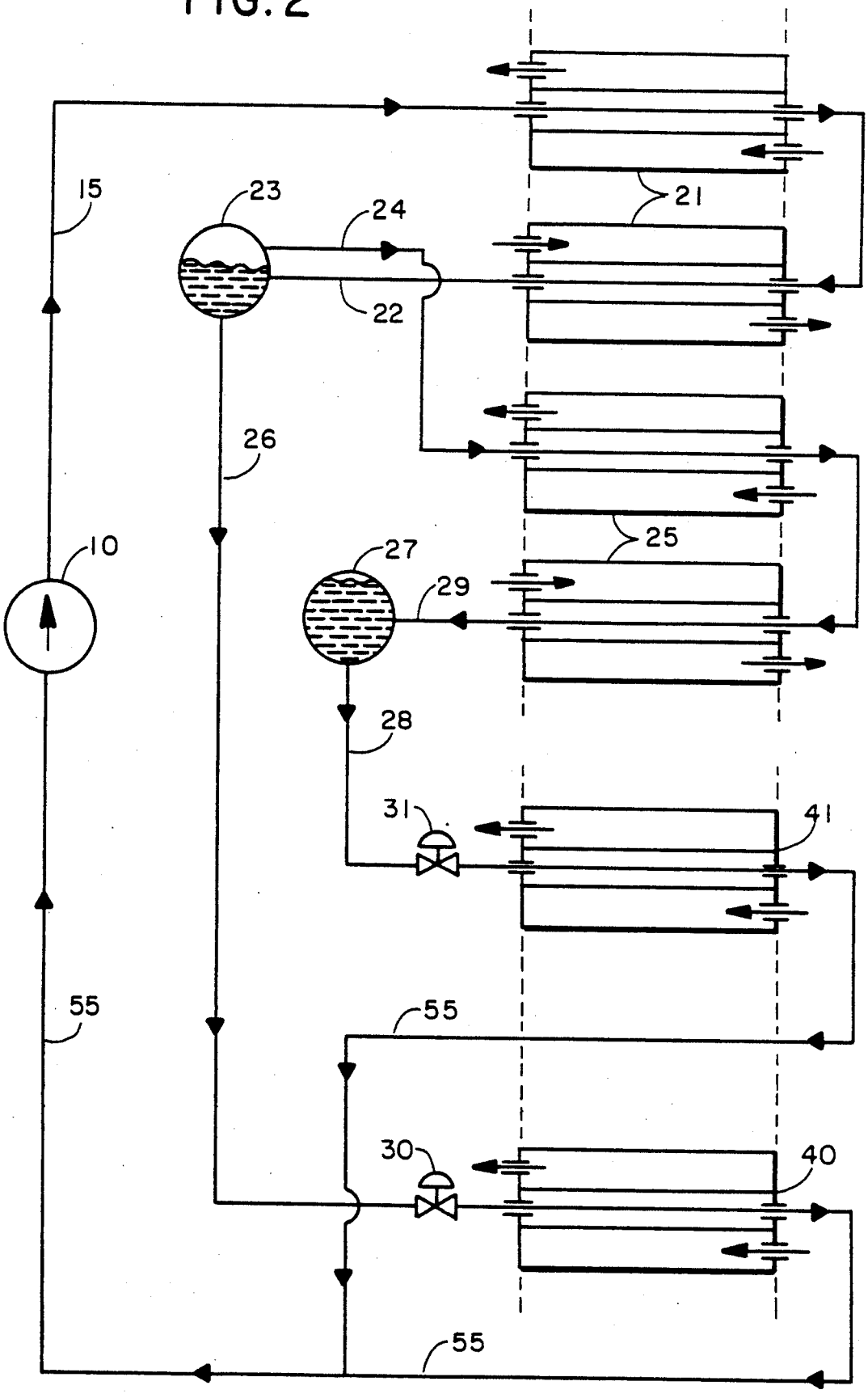
FIG. 2 is a schematic graph of an embodiment of the vapor compression device in which there is separation only during condensation.

A second preferred embodiment has high pressure separation of liquid and vapor in a condenser of a vapor compression refrigeration device but does not have separation in the evaporator. This embodiment is illustrated in FIG. 2. Pipe 15, which carries high pressure vapor mixture, connects a compressor 10 to the inlet of a condenser section 21. Pipe 22 carries partly-condensed non-azeotropic mixture from the outlet of this condenser section to a high pressure separator 23, which separates the partly condensed mixture into a vapor component and a liquid component. The vapor component leaves separator 23 through pipe 24 to enter condenser section 25. In the embodiment illustrated in FIG. 2, there is one separation in the condenser and the non-azeotropic mixture is fully condensed in condenser section 25. However, in general, there may be a plurality of condenser sections 21 from which partly condensed mixture is transported to separators 23. Fully-condensed mixture is carried by pipe 29 to receiver 27.

High pressure liquid mixtures are carried through pipes 26, and 28, from separator 23 and receiver 27, respectively, to expansion devices 30 and 31. Low pressure liquid mixture leaving expansion device 30 and 31 enter evaporator sections 40 and 41, respectively where the mixtures are fully evaporated and transported through pipes 55 to compressor 10. The number of evaporator sections, and associated expansion devices, is equal to the number of condenser sections. In contrast to the condenser sections which are in series, the evaporator sections are in parallel, with liquid from each high pressure separator, or the receiver 27, being evaporated in a different evaporator section.

Figure 3:
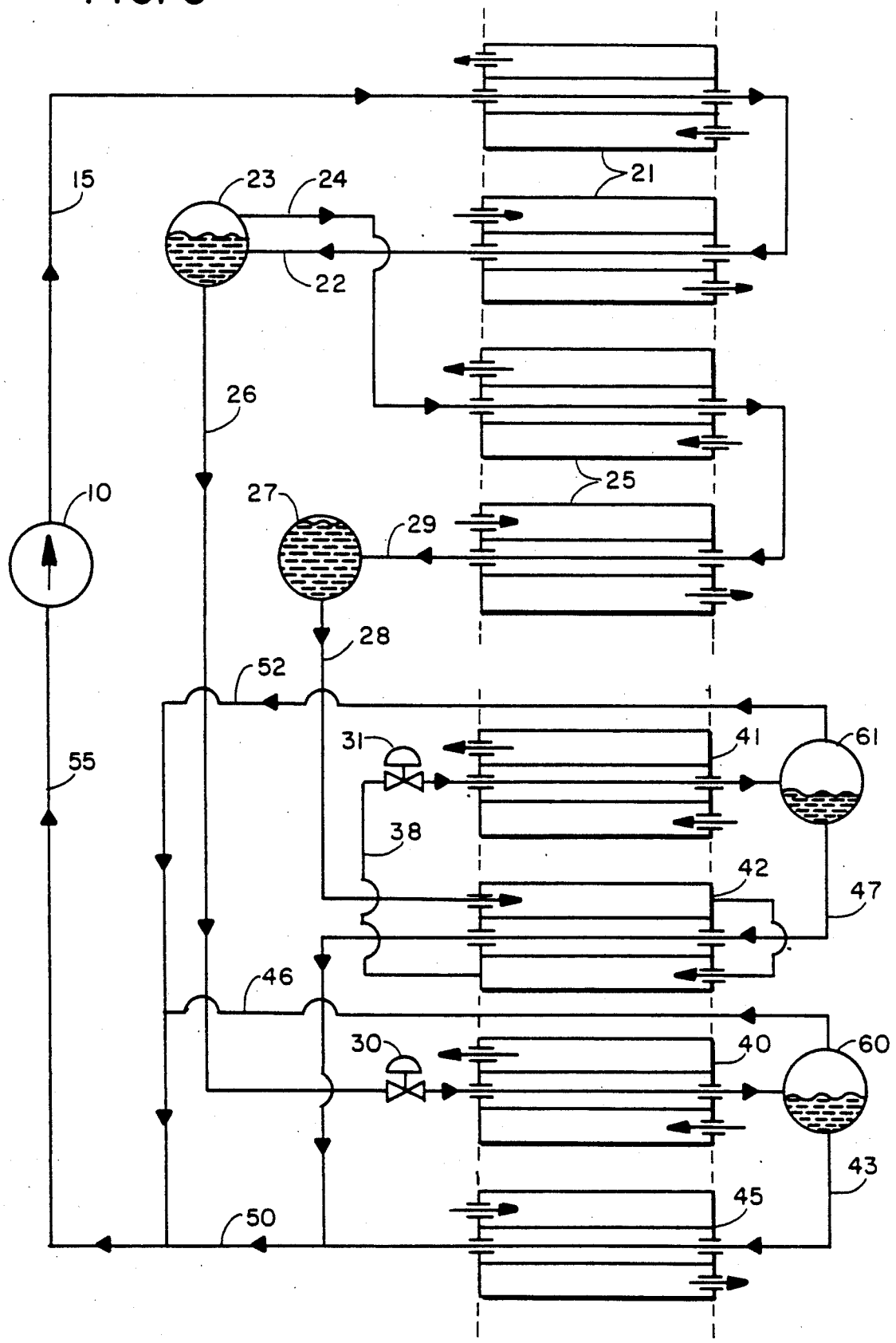
FIG. 3 is a schematic graph of an evaporator for an embodiment in which there is separation both during condensation and evaporation. Also there is an economizer to subcool the liquid mixture entering an evaporator.

A third preferred embodiment has separation during both condensation and evaporization. The vapor compression refrigeration device could be similar to that device illustrated in FIG. 2 except that each evaporator section could be replaced by an evaporator with a plurality of separation as illustrated in FIG.1. An evaporator with separation when used in a vapor compression refrigeration device with separation during both condensation and evaporization can have an economizer to subcool liquid entering an evaporator section to eliminate flash gas. This embodiment is illustrated in FIG. 3 when liquid mixture from condenser receiver 27 enters an evaporator section with an economizer and liquid mixture from condenser separator 23 enters an evaporator section without an economizer. High pressure liquid mixture from separator 23 is transported in pipe 26 to an expansion device 30. After expansion in expansion device 30, low pressure liquid enters evaporator circuit 40 in which it is partly evaporated. The two phases are separated in separator 60 with the liquid mixture being transported in pipe 43 to evaporator section 45 where it is fully evaporated and leaves in pipe 50. Vapor mixture leaves separator 60 in pipe 46. In the evaporator section with the economizer, high pressure liquid mixture from receiver 27 in transported in pipe 28 to evaporator circuit 42 where it is subcooled by low pressure liquid from separator 61. After subcooling in evaporator circuit 42, the high pressure liquid mixture is carried in pipe 38 to expansion device 31 where it is expanded and then enters evaporator circuit 41. After being partly evaporated in evaporator circuit 41, the liquid component and the vapor component are separated in low pressure separator 61. The liquid mixture component is carried in pipe 47 to evaporator circuit 42. Vapor mixture from pipes 46, 50, and 52, are carried in pipe 55 to the compressor.

The above-described embodiments of this invention are intended to be exempletive only and not limiting. For example, in the figures, counter-flow heat exchange in the condensers and evaporators are illustrated. Although, counter-flow heat exchange is preferred, cross-flow and parallel-flow heat exchangers are also acceptable.

What is claimed is:

1. An evaporator-separator system for use in a vapor compression refrigeration device that has compressor means, condenser means, expansion means and that uses a non-azeotropic refrigerant composed of a mixture of two or more refrigerants of different boiling temperatures, said evaporator-separator system comprising:

one or a plurality of sections, each section having an evaporator with an inlet and an outlet in which said non-azeotropic refrigerant is not fully evaporated, a separator for separating liquid mixture and vapor mixture at low pressure, with an inlet, an outlet for vapor mixture and an outlet for liquid mixture, a first piping means connecting the outlet of said evaporator of a section with said inlet of the separator of a section, a second piping means connecting said vapor mixture outlet of the separator of a section with said compressor means, and a third piping means connecting said liquid mixture outlet of the separator of a section with said inlet of the evaporator of another section; and A final section having an evaporator with an inlet and an outlet in which the non-azeotropic refrigerant is fully evaporated, a piping means connecting said outlet of the final section evaporator with said compressor means, said inlet of the final section evaporator being connected by said third piping means of another section with said liquid mixture outlet of the separator of said other section.

2. A vapor compression refrigeration device as claimed in claim 1 in which an evaporator section is an evaporator-separator system as claimed in claim 1.

3. A vapor compression refrigeration device as claimed in claim 2 in which there is an economizer means that subcools liquid mixture that enters an evaporator section.

4. A vapor compression refrigeration device using a non-azeotropic refrigerant composed of a mixture of two or more refrigerants of different boiling temperatures comprising:

compressor means; one or a plurality of condenser sections, each condenser section having a condenser with an inlet to receive high pressure vapor mixture and an outlet to discharge partly condensed liquid-vapor mixture at high pressure, a high pressure separator with an inlet, an outlet for vapor mixture and an outlet for liquid mixture, a first piping means for connecting said outlet of the condenser of a condenser section with said inlet of the separator of said condenser section, and a second piping means connecting said vapor mixture outlet of the separator of a condenser section with said inlet of the condenser of another condenser section;

a final condenser section having a condenser with an inlet and an outlet, a high pressure receiver having an inlet and an outlet, a piping means connecting said outlet of the condenser of the final condenser circuit with said inlet of the high pressure receiver, and where said inlet to the condenser of the final condenser circuit is connected to the vapor mixture outlet of the separator of another condenser circuit by the second piping means of said other condenser circuit;

a plurality of expansion devices equal in number to the number of condenser sections;

a plurality of third piping means, each third piping means connecting an expansion device with a liquid mixture outlet of a high pressure separator in a condenser section, or for said final condenser section with the outlet of the high pressure receiver;

a plurality of evaporator sections, each evaporator section has an evaporator in which said refrigerant is fully evaporated with an inlet and an outlet, a first evaporator piping means connecting said inlet of the evaporator of an evaporator section with an expansion device, and a second evaporator piping means connecting said outlet of the evaporator of an evaporator section to said compressor means.

* * * * *

UNITED STATES PATENT AND TRADEMARK OFFICE

CERTIFICATE OF CORRECTION

PATENT NO. : 4,987,751

DATED : January 29, 1991

INVENTOR(S) : Joseph M. Lewen

It is certified that error appears in the above-identified patent and that said Letters Patent is hereby corrected as shown below:

Column 4, line 20, claim number "2" should read --3--; line 21, claim number "1" should read --2--; line 23, claim number "3" should read --4--; line 24, claim number "2" should read --3--; and line 27, claim number "4" should read --2--.

Signed and Sealed this

Thirty-first Day of March, 1992

*Attest:*

HARRY F. MANBECK, JR.

*Attesting Officer*

*Commissioner of Patents and Trademarks*